United States Patent [19]

Madsen

[11] Patent Number: 4,828,541

[45] Date of Patent: May 9, 1989

[54] DECANTER CENTRIFUGE

[75] Inventor: Niels F. Madsen, Bagsvaerd, Denmark

[73] Assignee: Alfa-Laval Separation A/S, Soborg, Denmark

[21] Appl. No.: 138,380

[22] PCT Filed: May 5, 1987

[86] PCT No.: PCT/DK87/00050

§ 371 Date: Jan. 4, 1988

§ 102(e) Date: Jan. 4, 1988

[87] PCT Pub. No.: WO87/06856

PCT Pub. Date: Nov. 19, 1987

[30] Foreign Application Priority Data

May 6, 1986 [DK] Denmark ..... 2095/86

[51] Int. Cl.[4] ..... B04B 1/20; B04B 3/04

[52] U.S. Cl. ..... 494/53; 494/43

[58] Field of Search ..... 494/43, 46, 53, 66, 494/83, 84, 11, 30, 41, 8, 10, 52, 54; 210/781, 782, 360.1; 422/100, 102

[56] References Cited

U.S. PATENT DOCUMENTS

| | | | |
|---|---|---|---|
| 2,679,974 | 6/1954 | Gooch | 494/83 |
| 3,148,145 | 9/1964 | Reed | 494/83 X |
| 3,802,621 | 4/1974 | Merzenich | 494/53 X |
| 3,854,658 | 12/1974 | Probstmeyer | 494/83 X |
| 4,209,128 | 6/1980 | Lyons . | |
| 4,298,159 | 11/1981 | Epper et al. | 494/53 X |
| 4,714,456 | 12/1987 | Bender et al. | 494/36 |

FOREIGN PATENT DOCUMENTS

| | | | |
|---|---|---|---|
| 2525930 | 12/1976 | Fed. Rep. of Germany . | |
| 2819399 | 11/1978 | Fed. Rep. of Germany . | |
| 907026 | 2/1946 | France . | |
| 1257256 | 11/1986 | Japan | 494/53 |
| 345210 | 5/1972 | Sweden . | |
| 1397172 | 6/1975 | United Kingdom . | |

*Primary Examiner*—Timothy F. Simone

*Attorney, Agent or Firm*—Banner, Birch, McKie & Beckett

[57] ABSTRACT

The decanter centrifuge (1) comprises a conveyor screw (5) constructed as a hollow body with a lower average density than the lighter liquid phase of the surrounding slurry. The conveyor (5) thus flows in said liquid phase which is utilized in that the one traditional radial bearing of the conveyor is replaced by a radial support bearing (22) which only during starting and stopping of the centrifuge cooperates with the conveyor (5) in order to prevent it from contacting the bowl (2). In operation, the conveyor is thus only supported in the radial direction at the one end, entailing that the flexural rigidity of the conveyor becomes less important to the maximum allowable number of revolutions of the centrifuge which may then be increased for a given centrifuge, thereby obtaining an improved separating effect.

6 Claims, 2 Drawing Sheets

DECANTER CENTRIFUGE

BACKGROUND OF THE INVENTION

This invention relates to a decanter centrifuge comprising an axially symmetrical bowl and a conveyor screw journalled therein.

Such a decanter centrifuge is employed for separating a slurry supplied to the interior of the bowl into a solids phase and one or more liquid phases. This is obtained by rotating the entire centrifuge at a high number of revolutions and rotating at the same time the conveyor at a low number of revolutions relative to the bowl.

The separating effect of the centrifuge and its capacity or throughput depend, on one hand, on the magnitude of the field of gravitation generated by the centrifugal force in the separating space of the bowl, i.e. on the number of revolutions and the inner diameter of the bowl and, on the other hand, on the length of the separating space.

A factor of decisive importance for the maximum allowable number of revolutions is the flexural rigidity of the conveyor radially supported at both ends of the bowl because the flexural rigidity determines the critical number of revolutions of the conveyor.

This fact has hitherto implied that the λ-value of a given centrifuge—the λ-value being defined as the ratio between the length and the inner diameter of the separating space—has not in practice exceeded values of about 5.

In cases where a large field of gravitation and a large capacity have been required, the resulting centrifuges have been excessively large and expensive. This relates to the fact that a straight geometrically enlargement of a given decanter centrifuge has caused the costs of manufacture to increase by the cube of the scale ratio, while the capacity only increases by the square of the scale ratio.

In view of the fact that, inversely, a capacity increase proportional to the extension is obtained simply by increasing the length of the centrifuge—without a corresponding rise in price—it is obvious to aim at producing decanters having λ-values exceeding said approx. 5.

SUMMARY OF THE INVENTION

This is now made possible by a decanter centrifuge according to the invention which differs from the prior art centrifuges in that the average density of the conveyor, i.e. the ratio between its total weight and the volume it displaces, is smaller than the density of the lighter liquid phase of the actual slurry, and in that at least one end of the conveyor in operation is unsupported in the radial direction in relation to the bowl.

The invention will now be described in more detail with reference to the drawings in which

DESCRIPTION OF THE PREFERRED EMBODIMENTS

Figure 1:
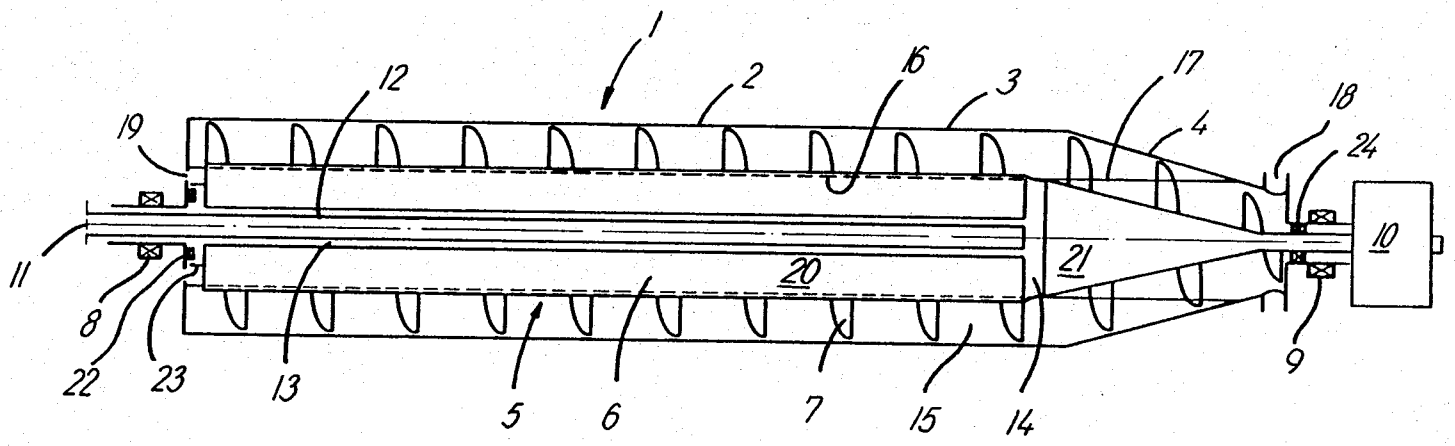
FIG. 1 is a schematical longitudinal section through a decanter centrifuge according to the invention, in operation.

The decanter centrifuge 1 illustrated in FIG. 1 consists by and large of a horizontal, axially symmetrical bowl 2 with a cylindrical section 3 and a conical section 4. The bowl 2 includes an elongated conveyor screw 5 with a central body portion 6 and surrounded by a continuous screw flight 7. The bowl is at its ends rotatably supported in bearings 8 and 9, respectively, and is driven via a gear 10—for example an epicyclic gear—ensuring in a known manner that bowl 2 and conveyor 5 in operation rotate relative to each other.

The suspension to be separated is supplied through an inlet 11 in the form of an inlet tube 12 and extending coaxially with the axis of rotation of the centrifuge through a central passage 13 provided in conveyor body 6. The tube 12 ends in a transverse, radial passage 14 discharging into the separating space 15 of the centrifuge. The liquid level in operation is illustrated in dotted lines 16 and solid lines 17. After separation in space 15 solids are discharged through apertures 18 while liquid is discharged through an annular outlet 19.

Conveyor 5 is by and large constructed as a hollow body with closed cavities 20 and 21 and is so dimensioned that the average density of the conveyor as a whole is smaller than the density of the ligter liquid phase of the actual suspension. In this context the average density of the conveyor is defined as the ratio between the total weight of the conveyor and the volume it displaces.

In other words, the conveyor is able to flow in said light liquid phase which in operation constitutes the innermost portion of the "liquid tube" generated by centrifugal forces and positioned along the internal surface of the bowl wall.

By adjusting the liquid level in separating space 15—i.e. the wall thickness of the liquid tube—so that the outer surface of body portion 6 is substantially covered, it is obtained that the conveyor body may be regarded as approximately fully submerged and therefore in possession of a certain positive buoyancy. The result is that the conveyor will constantly seek towards the surface which in operation will mean towards the axis of rotation. The conveyor is in other words self-centering. Said effect has in practice proven to be independent of the degree of overlapping between the outer diameter of the body portion and the inner diameter of the liquid tube, provided a certain overlapping exists.

This floating and self-centering ability of the conveyor in operation is in the embodiment illustrated in FIG. 1 utilized for omitting one of the traditional radial bearings of the conveyor (in casu at the large end).

Instead there is, as illustrated, provided a radial support bearing 22 the radial external surface of which is adapted to cooperate periodically with the radial internal surface of a circular collar 23 on the conveyor body. There is a certain radial clearance between the outer diameter of the supporting bearing and the inner diameter of the collar. Consequently, the bearing and the collar will only cooperate when the radial oscillation of the conveyor from the axis of rotation at the large end exceeds said clearance. This will for instance be the case when the centrifuge does not rotate or rotates at such a low number of revolutions that the liquid tube cannot be maintained and thus has no supporting ability. The clearance is so dimensioned that the conveyor in no circumstances can contact the bowl wall.

At the small end the conveyor is journalled in an ordinary way by means of a traditional radial bearing 24. Said bearing may possibly be a spheric bearing in order to allow the slight angular movements of the conveyor which is a consequence of its radial deflection at the large end. A second possibility of allowing said angular movement is to make use of a sort of a diaphragm coupling between the drive shaft of the conveyor at the small end and the conveyor body proper. Moreover, the conveyor is, in a manner not shown, controlled in the axial direction.

As mentioned in the introduction it is in current centrifuges the conveyor—or rather its flexural rigidity—which in practice determines the maximum allowable number of revolutions of the centrifuge.

This is due to the fact that the conveyor is constantly supported at both ends in the radial direction. By suspending, in operation, the radial support of the one end of the conveyor, as described above, the decisive influence of the flexural rigidity is reduced, meaning that the λ-ratio of the centrifuge as well as its maximum allowable number of revolutions can be increased.

The diminished demands on strength makes it possible to obtain the weight reduction necessary for constructing the conveyor with an average density not exceeding the density of the lighter liquid phase, inter alia because the conveyor body may now be made from sheet material. As an example of the size of the weight reduction obtained it can be mentioned that the conveyor of a given traditionally constructed centrifuge has a weight of about 400 kg, while the conveyor of a corresponding centrifuge according to the invention can be manufactured with a weight of only about 100 kg.

Figure 2:
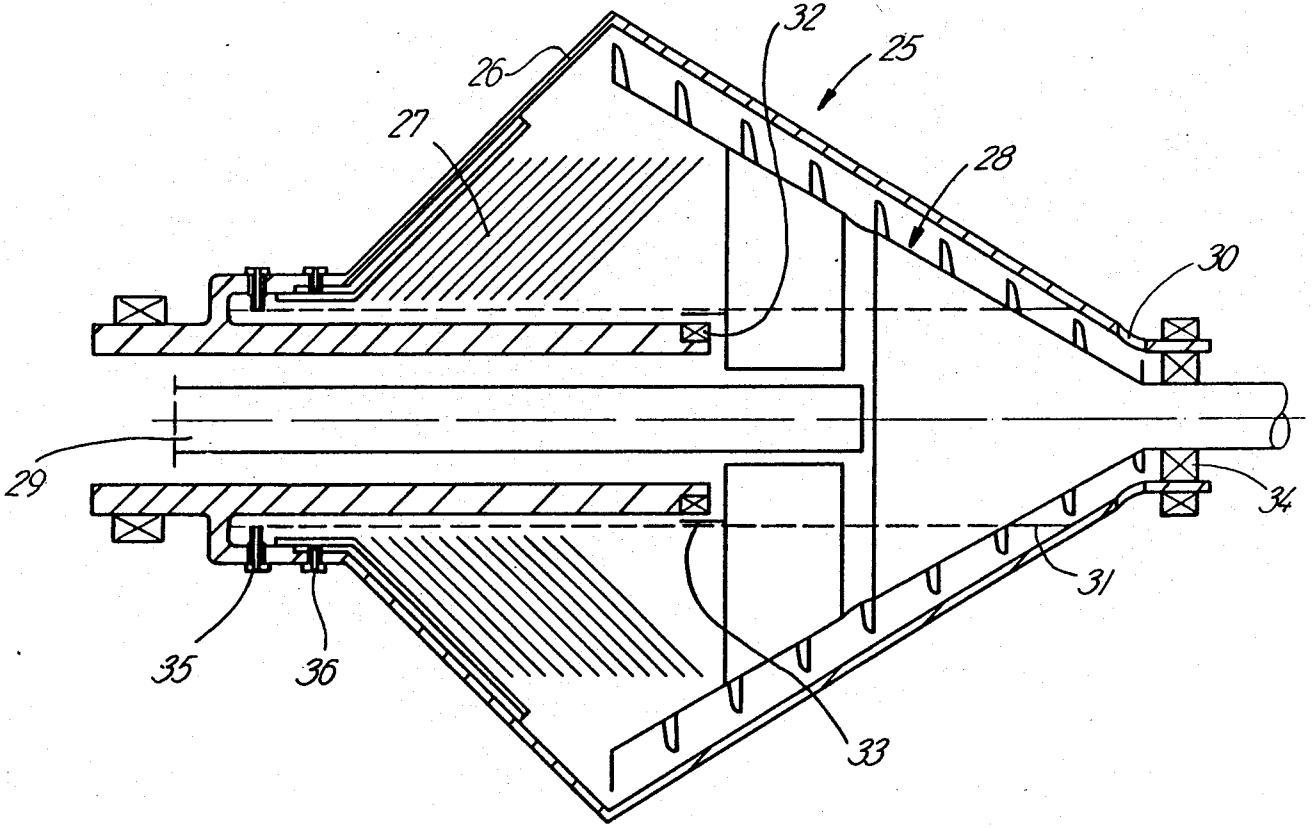
FIG. 2 is a section as FIG. 1, but through a second embodiment of a centrifuge according to the invention.

FIG. 2 illustrates a second embodiment of a centrifuge according to the invention, namely a so-called disc decanter 25, i.e. a centrifuge including a pile of discs as well as a conveyor screw.

Centrifuge 25 comprises a double-conical bowl 26 at the one end of which a pile of discs 27 is arranged which rotates with the bowl and at the other end of which a conveyor screw 28 is mounted which in operation rotates relative to bowl 26. The actual slurry is supplied through an inlet 29 and the separated phases are discharged from the bowl through apertures 30 and outlets 35 and 36, respectively, at the left-hand end of bowl 26 in FIG. 2. The liquid level in operation is designated by 31. The mode of operation of such a centrifuge is known and will therefore not be explained in detail here.

As above, conveyor 28 is constructed as a hollow body the radial journalling of which at the one end is effected by means of a periodically active, radial support bearing 32 and an annular collar 33. In this case too, the other end of the conveyor is journalled by means of an ordinary radial bearing 34 and the conveyor is likewise controlled in the axial direction in relation to the drum.

The radial support bearing is in both specified embodiments arranged at the "large end" of the conveyor, this being advantageous because the conveyor has there a comparatively greater buoyancy than at the small end. This relates to the fact that the body portion is conically tapered at the small end and thus accommodates less buoyancy promoting cavity volume per unit of length than is the case at the large end. Moreover, the conveyor is not fully submerged at the small end. There is, however, nothing to prevent the support bearing from being positioned in other embodiments at the small end, and it is also possible to provide the conveyor with support bearings at both ends.

I claim:

1. A decanter centrifuge for separating a slurry into a heavier phase and a lighter phase, which comprises:

an axially symmetrical bowl; and a screw conveyor, rotatably located in the bowl, having a body with at least one flight, wherein a specific density of the screw conveyor is lower than a specific density of the lighter liquid phase of the slurry and, in operation, at least one end of the screw conveyor is radially unsupported.

2. A decanter centrifuge as in claim 1, further comprising means, disposed on the centrifuge, for radially supporting one end of the screw conveyor.

3. A decanter centrifuge as in claim 1, further comprising means, arranged at the at least one unsupported end of the screw conveyor, for preventing contact between the at least one flight of the screw conveyor and the bowl during starting and stopping of the centrifuge.

4. A decanter centrifuge for separating a slurry into a heavier phase and a lighter phase, which comprises:

an axially symmetrical bowl; and a screw conveyor, rotatably located in the bowl, having a body with flights, wherein a specific density of the screw conveyor is lower than a specific density of the lighter liquid phase of the slurry, and, in operation, at least one end of the screw conveyor is radially unsupported, and whereby, when in operation, the at least one unsupported end of the screw conveyor is centered in relation to the bowl by buoyancy forces acting on the screw conveyor.

5. A decanter centrifuge as in claim 4, further comprising a bearing, disposed on the centrifuge, for radially supporting one end of the screen conveyor.

6. A decanter centrifuge as in claim 4, further comprising a limiting device, arranged at the at least one unsupported end of the screw conveyor, for preventing contact between the flights of the screw conveyor and the bowl during starting and stopping of the centrifuge.

* * * * *